US006622318B2

(12) United States Patent
Mathis

(10) Patent No.: US 6,622,318 B2
(45) Date of Patent: Sep. 23, 2003

(54) POOL COVER SYSTEM WITH RETRACTING AND ADJACENT EXTENDING MECHANISMS OPERABLE BY A PORTABLE POWER SOURCE

(75) Inventor: Wesley L. Mathis, Draper, UT (US)

(73) Assignee: Pool Cover Specialists National, Inc., West Jordan, UT (US)

( * ) Notice: Subject to any disclaimer, the term of this patent is extended or adjusted under 35 U.S.C. 154(b) by 0 days.

(21) Appl. No.: 09/753,247

(22) Filed: Dec. 29, 2000

(65) Prior Publication Data

US 2001/0029626 A1 Oct. 18, 2001

Related U.S. Application Data

(63) Continuation of application No. 09/734,317, filed on Nov. 30, 2000.

(60) Provisional application No. 60/168,172, filed on Nov. 30, 1999.

(51) Int. Cl.[7] ..... E04H 4/00

(52) U.S. Cl. ..... 4/502; 4/498; 242/919

(58) Field of Search ..... 4/498, 496, 500, 4/502; 242/390.8, 919

(56) References Cited

U.S. PATENT DOCUMENTS

| | | | |
|---|---|---|---|
| 2,815,809 | A | 12/1957 | Jacobs et al. |
| 2,958,083 | A | 11/1960 | Shook et al. |
| RE25,078 | E | 11/1961 | McGuire |
| 3,050,743 | A | 8/1962 | Lamb |
| 3,277,498 | A | 10/1966 | Kleinbard et al. |
| 3,748,664 | A | 7/1973 | Morita |
| 3,979,782 | A | 9/1976 | Lamb |
| 4,001,900 | A | 1/1977 | Lamb |
| 4,060,860 | A | 12/1977 | Lamb |
| 4,195,370 | A | 4/1980 | Budd |
| 4,203,174 | A | 5/1980 | Shults |
| 4,351,072 | A | 9/1982 | Smith |
| 4,433,589 | A | 2/1984 | Chaconas |
| 4,459,711 | A | 7/1984 | Sartain et al. |
| 4,464,801 | A | 8/1984 | Lamb |
| 4,466,144 | A | 8/1984 | Lamb |
| 4,494,707 | A | 1/1985 | Niibori et al. |
| 4,675,922 | A | 6/1987 | Colin et al. |
| 4,686,717 | A | 8/1987 | MacDonald et al. |
| 4,811,433 | A | 3/1989 | MacDonald et al. |
| 4,815,152 | A | 3/1989 | MacDonald et al. |
| 4,858,253 | A | 8/1989 | Lamb |
| 4,939,798 | A | 7/1990 | Last |
| 5,044,022 | A | 9/1991 | Hess |
| 5,105,481 | A | 4/1992 | Lamb et al. |
| 5,184,356 | A | 2/1993 | Löf et al. |
| 5,184,357 | A | 2/1993 | Last |
| 5,277,350 | A | 1/1994 | Thornbury, Jr. |
| 5,327,590 | A | 7/1994 | Last |
| 5,394,815 | A | 3/1995 | Hansen |
| 5,524,302 | A | 6/1996 | Ragsdale et al. |
| 5,890,240 | A | 4/1999 | Graham |
| 5,913,613 | A | 6/1999 | Ragsdale et al. |
| 5,920,922 | A | 7/1999 | Ragsdale et al. |

OTHER PUBLICATIONS

American Society for Testing and Materials, Standard ES 13–89, Emergency Standard Performance Specification for Safety Covers and Labeling Requirements for All Covers for Swimming Pools, Spas and Hot Tubs, (1989).

*Primary Examiner*—Michael Powell Buiz
*Assistant Examiner*—Tuan Nguyen
(74) *Attorney, Agent, or Firm*—Clayton, Howarth & Cannon, P.C.

(57) ABSTRACT

A pool cover system including a pool cover collecting drum supported for rotation on its ends and a drive gear connected to the drum by a drive shaft. A power gear is operably connected to a portable electric drill by a power shaft, engaging the drive gear. Upon activation of the drill, the collecting drum rotates retracting the pool cover. A complementary apparatus on the same side of the pool, such as a rope reel collecting apparatus having an engageable drive gear and a drive shaft connected to a reel, extends the pool cover over the pool by pulling on a rope attached to a rigid end of the pool cover. The pool cover is extended and retracted with the sides sliding in one channel of a dual channel track, allowing the cover to serve as a safety cover.

104 Claims, 6 Drawing Sheets

POOL COVER SYSTEM WITH RETRACTING AND ADJACENT EXTENDING MECHANISMS OPERABLE BY A PORTABLE POWER SOURCE

CROSS-REFERENCE TO RELATED APPLICATIONS

This application is a continuing application of co-pending U.S. patent application Ser. No. 09/734,317, filed on Nov. 30, 2000, entitled "POOL COVER SYSTEM," which is hereby incorporated herein by reference in its entirety and which claims the benefit of U.S. Provisional Application No. 60/168,172, filed on Nov. 30, 1999, which is hereby incorporated herein by reference in its entirety.

STATEMENT REGARDING FEDERALLY SPONSORED RESEARCH OR DEVELOPMENT

Not applicable.

BACKGROUND OF THE INVENTION

1. The Field of the Invention

The present invention relates generally to extendable and retractable cover systems, and more particularly, but not entirely, to a dual-shaft drive mechanism for flexible pool covers that may be activated using a portable low voltage power source.

2. Description of Related Art

Swimming pools and related structures are extremely popular. Commercial and residential swimming pools typically consist of a water containment vessel that may reside below ground or above ground, including water-impermeable walls and a bottom surface.

In many circumstances, it is desirable for the user to place a protective barrier or pool cover over the pool when the pool is not in use. Such a pool cover serves many functions: it helps to conserve water normally lost through evaporation, it can prevent water contamination resulting from outside debris, it saves water treatment costs by reducing chemical loss, and it saves energy loss by retaining heat energy in the water. Perhaps most importantly, a properly installed pool cover that provides a safety feature can prevent accidental drowning of persons falling into the pool area.

While many pool cover devices have been developed, most are awkward and difficult to install and remove, thereby discouraging their use and inhibiting their benefits. Such devices require a high-torsion power source, or a manually-operable crank arm, and are therefore cumbersome and laborious to operate. Further, many of these devices require a user to act at both ends of the pool to cause the pool cover to be extended and retracted, an inconvenience which may discourage use of the pool, or worse, result in the pool being left uncovered.

Some pool cover devices known in the prior art, are those disclosed in U.S. Pat. No. 5,913,613 (granted Jun. 22, 1999 to Ragsdale, et al.), in U.S. Pat. No. 4,811,433 (granted Mar. 14, 1989 to MacDonald, et al.), in U.S. Pat. No. 4,459,711 (granted Jul. 17, 1984 to Sartain, et al.), and in U.S. Pat. No. 5,890,240 (granted Apr. 6, 1999 to Graham), among others. The Ragsdale and Macdonald references disclose devices that require major modification to an existing pool to prior to installation. An enclosure must be constructed to hold a pool cover system including multiple reels, shafts and a permanent electric motor. These systems require that electric lines which encumber the enclosure, and a separate control must be placed elsewhere. As a result, such devices can be expensive to manufacture and install. Installation of such a device is often too complex for a pool owner to attempt alone. Additionally, should the electricity go out, the pool cover may not be able to be opened or closed, until power is restored. Further they present the dangers of having an electric power line close to water to users of the pool.

The types of devices disclosed in Sartain and Graham constitute attempts to resolve some of the problems discussed above. A device such as the one shown in Graham has resulted in a pool cover system in which the drum moves along the pool or pool deck to roll up the cover. Since the cover is not fixedly attached to the pool deck, the Graham device fails to provide a safety cover. Similarly, Sartain fails to provide a cover having a high degree of safety allowing the pool to be unsafe even when covered.

Further, as a pool is covered or uncovered with a Graham type device using a portable drill, the user is required to walk alongside the device in an awkward position for the length of the pool. This inconvenience discourages use of the cover.

While Sartain teaches the use of a hand crank located at one end of the pool for the purpose of both covering and uncovering the pool, it still requires the user to attach a line to the cover, walk the line across the open pool, and then place the line through a system of pulleys located on the pool deck, discouraging use of the cover. Additionally, the amount of force needed to turn the crank prevents many users from covering and uncovering the pool without assistance when using a Sartain-type of device.

It is noteworthy that none of the prior art known to applicant provides a pool cover system with a safety cover that may be easily activated by a single user, that utilizes a low voltage portable power source, that is relatively inexpensive to make, simple in operation and installation, and that is completely operable from a single end of the pool by a single user.

The prior art is thus characterized by several disadvantages that are addressed by the present invention. The present invention minimizes, and in some aspects eliminates, the above-mentioned failures, and other problems, by utilizing the methods and structural features described herein.

BRIEF SUMMARY AND OBJECTS OF THE INVENTION

It is therefore an object of the present invention to provide a pool cover system that is relatively easy to operate.

It is also an object of the present invention, in accordance with one aspect thereof, to provide a pool cover system that provides a safety cover that may be operated by a single user from one end of a pool.

It is a further object of the present invention, in accordance with one aspect thereof, to provide a pool cover system that provides a safety cover, but does not require major modification of the pool deck.

It is another object of the present invention to provide such a pool cover system that is operable from a single end of a pool with only a low-torsion, low-voltage power source for operation.

The above objects and others not specifically recited are realized in a specific illustrative embodiment of a pool cover system including an apparatus for retracting a pool cover from over a pool, or extending a pool cover over a pool. The system includes a pool cover collecting drum supported for rotation on its ends, and a drive gear connected to the drum by a drive shaft. A power gear for engaging the drive gear is operably connected to a portable, battery operated electric drill by a power shaft. When the drill is activated, the drive gear rotates the pool cover collecting drum to collect and retract the pool cover from over the pool. The pool cover is placed back over the pool by utilization of a complementary apparatus on the same side of the pool, such as a rope reel collecting apparatus including an engageable drive gear and a drive shaft connected to a reel, to extend the pool cover over the pool by pulling on a rope attached to a rigid end or carrier of the pool cover. The sides of the pool cover are fed through, and supported by, a dual channel track. As the pool cover is extended and retracted it slides in one channel of the dual channel track, allowing the cover to serve as a safety cover. The gears may be located in a sealed housing filled with lubricant. It is preferred to locate the drive shafts of the cover collection apparatus and the rope reel collection apparatus in a co-linear parallel fashion with one residing directly above the other. The drive shafts may include a universal joint, and the drill may be designed to engage the power shaft with a flexible socket adapter.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
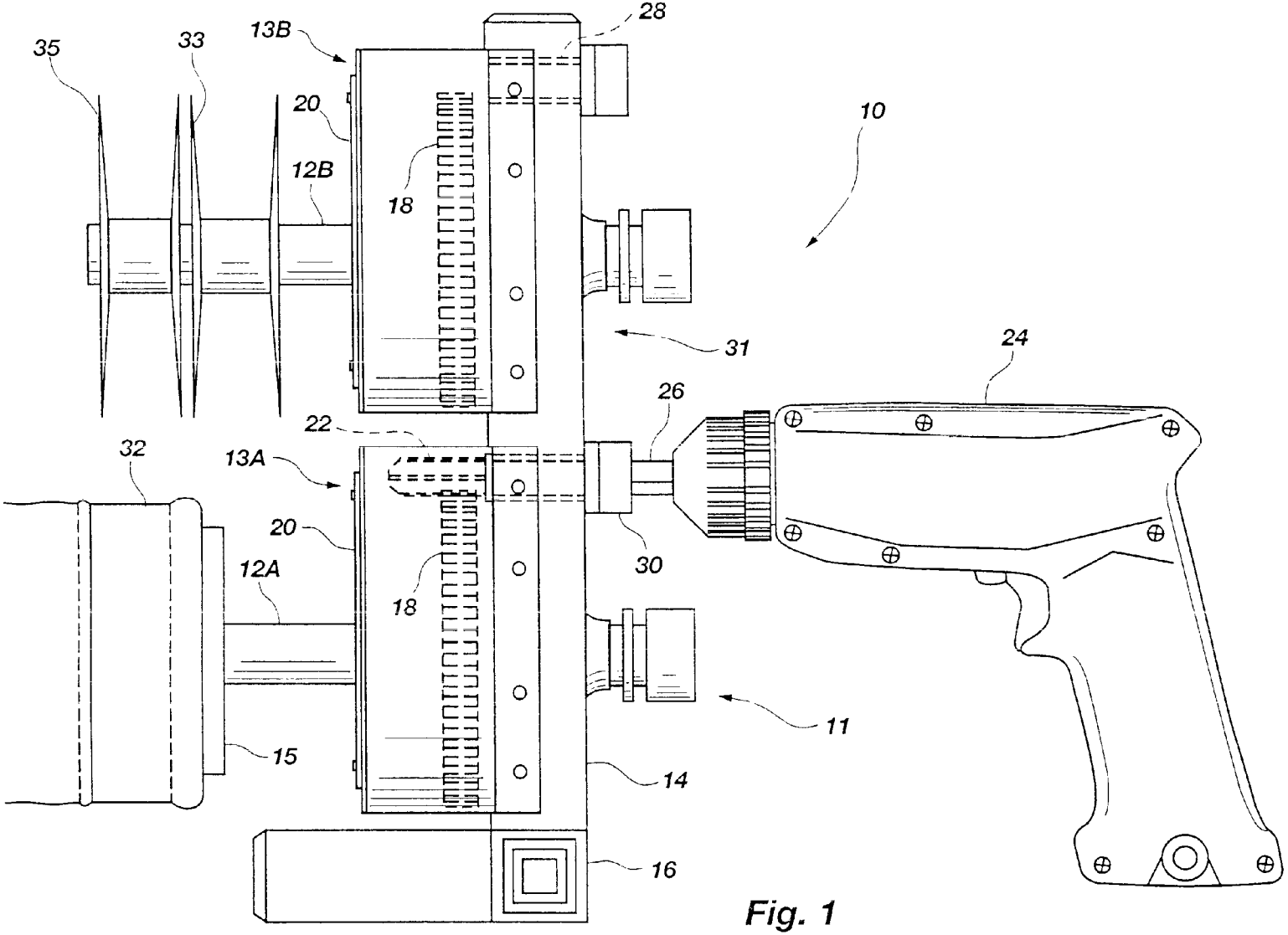
FIG. 1 is a side elevation view of one embodiment of a pool cover system for retracting and extending a pool cover over a pool, made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

It must be noted that, as used in this specification and the appended claims, the singular forms "a," "an," and "the" include plural referents unless the context clearly dictates otherwise.

In describing and claiming the present invention, the following terminology will be used in accordance with the definitions set out below.

As used herein, "comprising," "including," "containing," "characterized by," and grammatical equivalents thereof are inclusive or open-ended terms that do not exclude additional, unrecited elements or method steps.

Figure 4:
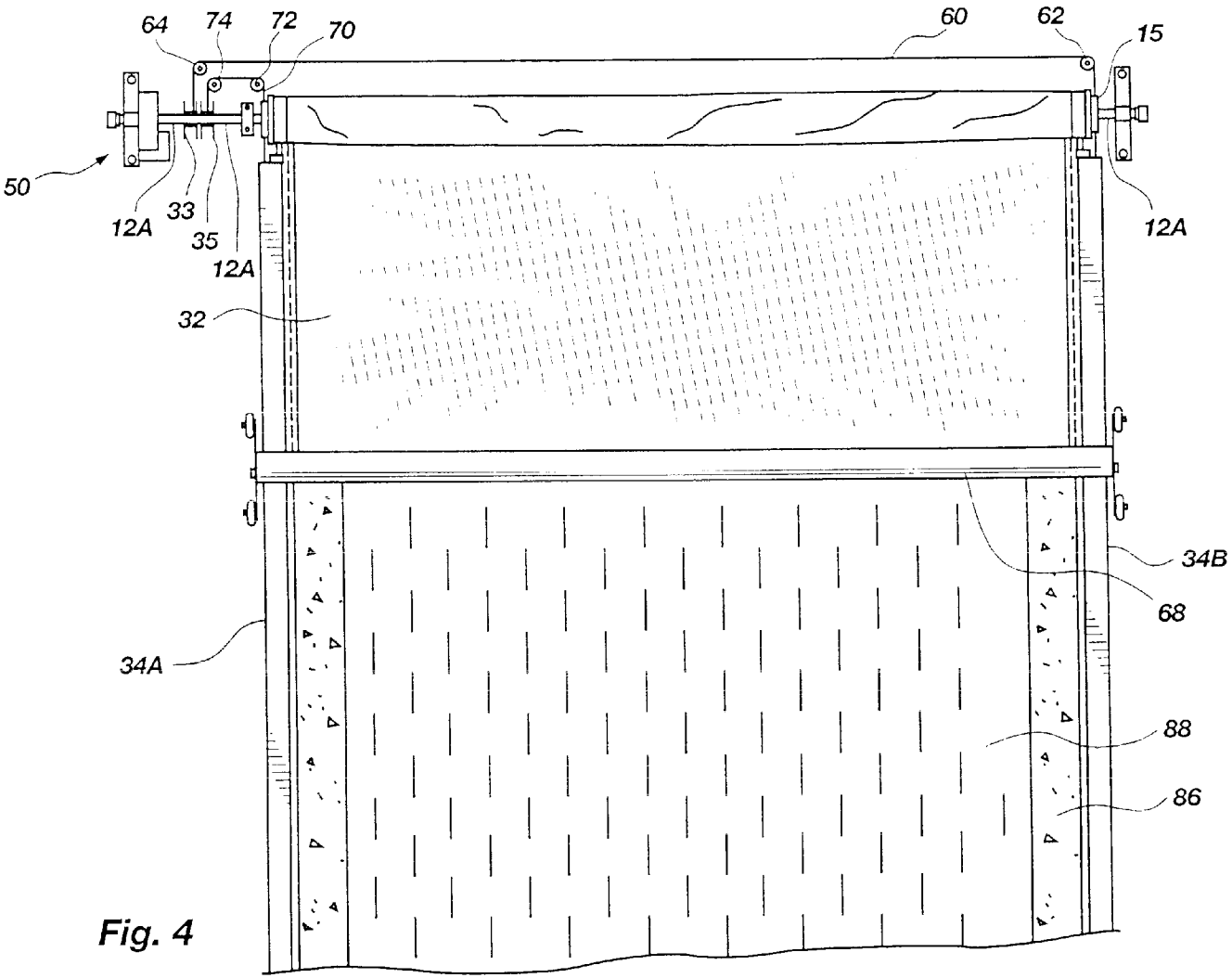
FIG. 4 is a plan view of the pool cover system of FIG. 3.
Figure 5:
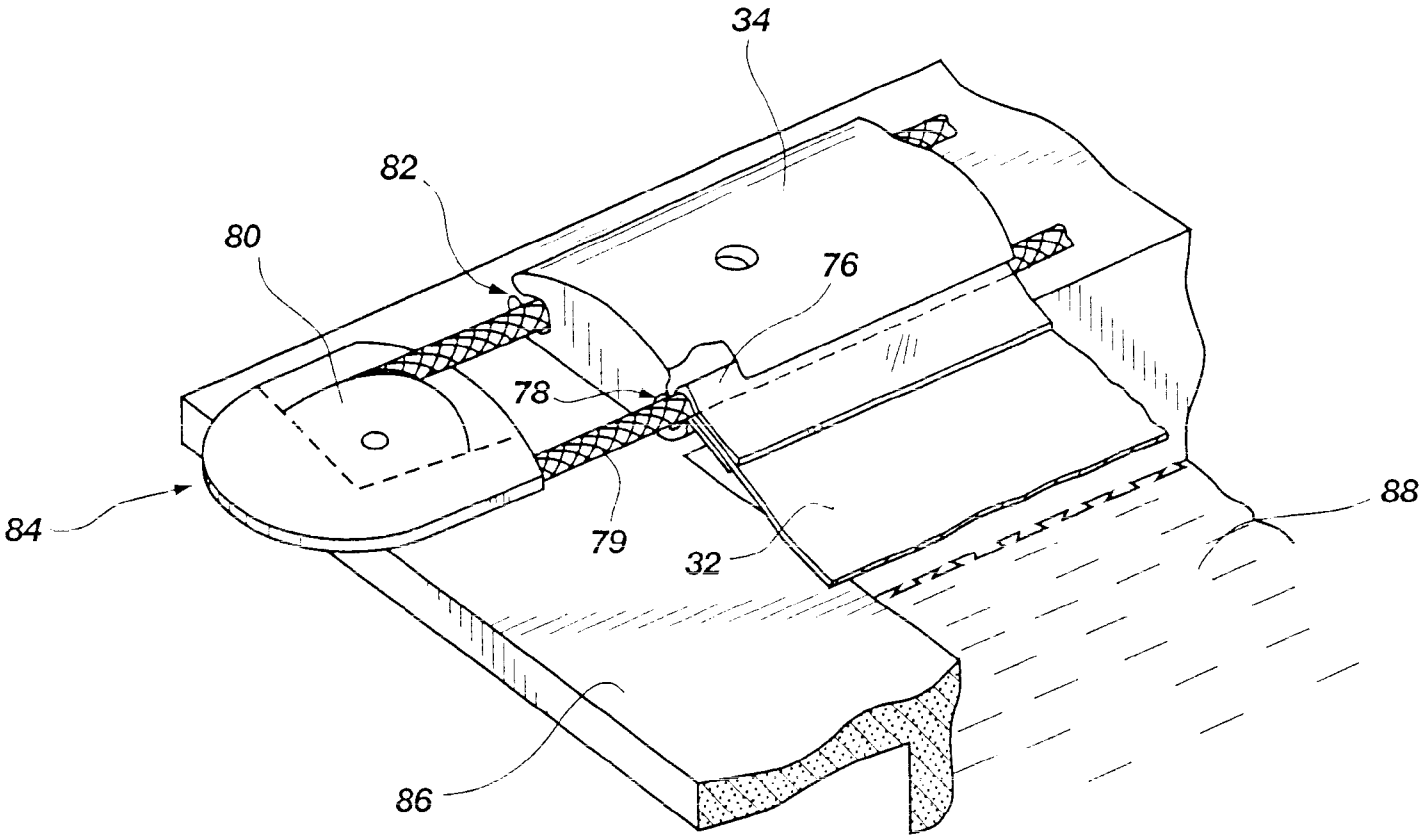
FIG. 5 is a perspective view of one embodiment of a pool cover track and line useful for practicing the present invention, made in accordance with the principles of the present invention.

Referring now to FIG. 1, there is shown a side elevation view of one possible embodiment of a pool cover system 10 including cover collecting apparatus, designated generally at 11, and including drive mechanism 13A of the present invention as used for retracting a pool cover 32 from over a pool 88 (shown in FIGS. 4 and 5). Cover collecting apparatus 11 includes a drive shaft 12A connected to a drum 15 on which the pool cover 32 is rolled. The pool cover 32 is preferably a flexible sheet that may be rolled onto the drum 15. While it is preferred that pool cover 32 be a flexible pool cover, although it will be appreciated that other types of pool covers, such as a rigid pool cover, or a pool cover made of rigid panels that fold or slide over one another, or are made of a combination of rigid and flexible segments may be used within the scope of the present invention. It will be appreciated that while a drum 15 is preferred, the drum 15 may be eliminated if desired and the cover 32 may be collected by rolling it directly onto the shaft 12A.

The drive shaft 12A is preferrably disposed in a substantially co-axial orientation with respect to the drum 15, and has a pair of ends and is supported for rotation on its ends by support structure 14 having a base 16, although any support structure capable of supporting the drive shaft 12A in a rotatable position may be used. The base 16 is preferably attached to a pool deck 86, (shown in FIGS. 4 and 5). The more preferred embodiments include the shaft 12 and a pool cover collecting drum 15 on which the cover is collected, but the drum 15 may be eliminated if desired. It will be appreciated that the embodiments disclosed herein, and other embodiments made in accordance with the principles of the present invention may serve as retracting means for retracting a pool cover from an extended position over a pool 88.

In the FIG. 1 embodiment, drive mechanism 13A includes gear reduction means provided by the drive gear 18 and the pinion gear 22. Drive gear 18 is operably connected to the drive shaft 12A, and is preferably covered by gear housing 20. In this embodiment, a removable power gear such as a pinion gear 22 is connected to a low voltage portable power source, such as a battery operated screw gun or an electric drill 24 having a power shaft 26 to which said pinion gear 22 is attached, and the pinion gear 22 engages drive gear 18 when the pinion gear 22 is inserted through aperture 28. It will be appreciated that any suitable power source is within the scope of the present invention, although a portable low voltage power source is preferred. Bearing 30 supports power shaft 26 within aperture 28, and permits rotation of the shaft. When pinion gear 22 is so engaged with drive gear 18, and the drill 24 is activated, drive gear 18 rotates the drive shaft 12 to collect and retract pool cover 32 from over the pool 88. In this embodiment, once the pool cover 32 has been retracted, the drill 24 and pinion gear 22 can be removed from the aperture. It will be appreciated that insertion of the pinion gear 22 into aperture 28 thus serves as an example of a coupling means for coupling the portable low voltage power source 24 such that the low voltage power source 24 may operate the drive mechanism and that any structure that may be used to accomplish this function is also included within the scope of the present invention.

Directly above the cover collecting apparatus 11 on the support structure 14 is the line collecting apparatus 31. The line collecting apparatus 31 includes a drive mechanism 13B which is similar in design to drive mechanism 13A, and is shown here with the pinion gear 22 uninstalled. The shaft 12B of the drive mechanism 13B rather than being attached to a drum 15 or used for collecting a pool cover 32, is instead attached to one or more reels, shown here as a preferred embodiment with two reels 33 and 35, although there may be as few as one reel or as many reels as needed. It will be appreciated that when a drive mechanism 11 is attached to a cover collecting apparatus 11, the shaft 12A serves as a retraction shaft, and when the drive mechanism 13B is attached to a line collection apparatus 31, the shaft 12B serves as an extension shaft.

When the line collection apparatus 31 is activated the one or more reels 33 and 35 rotate to allow the cover 32 to be retracted, through the collection of line (not shown). It will be appreciated that embodiments of the line collection apparatus 31 may be constructed where the drive mechanism 13B is directly attached to a reel 33, or multiple reels 33 without a shaft 12B are possible and are included within the scope of the present invention. It will also be appreciated that the line collection apparatus 31 may be used as part of an extending means for extending the pool cover 32 over the pool 88, but that any structure known, or readily ascertainable to those skilled in the art capable of being used to extend the cover to an extended posiiton may be used as an extending means.

In the FIG. 1 embodiment the shafts 12A and 12B of the cover collection apparatus 11 and the line collection apparatus 31 resides in a co-linear parallel fashion with one above the other. It will be appreciated that while this arrangement is preferred, the principles of the present invention may be practiced with an arrangement where the shafts do not reside in a parallel co-linear array. It will be further appreciated that while the FIG. 1, embodiment places the line collection apparatus 31 above the cover collection apparatus 11, other suitable arrangements known, or readily ascertainable, to those skilled in the art may be used and are within the scope of the present invention.

Figure 2:
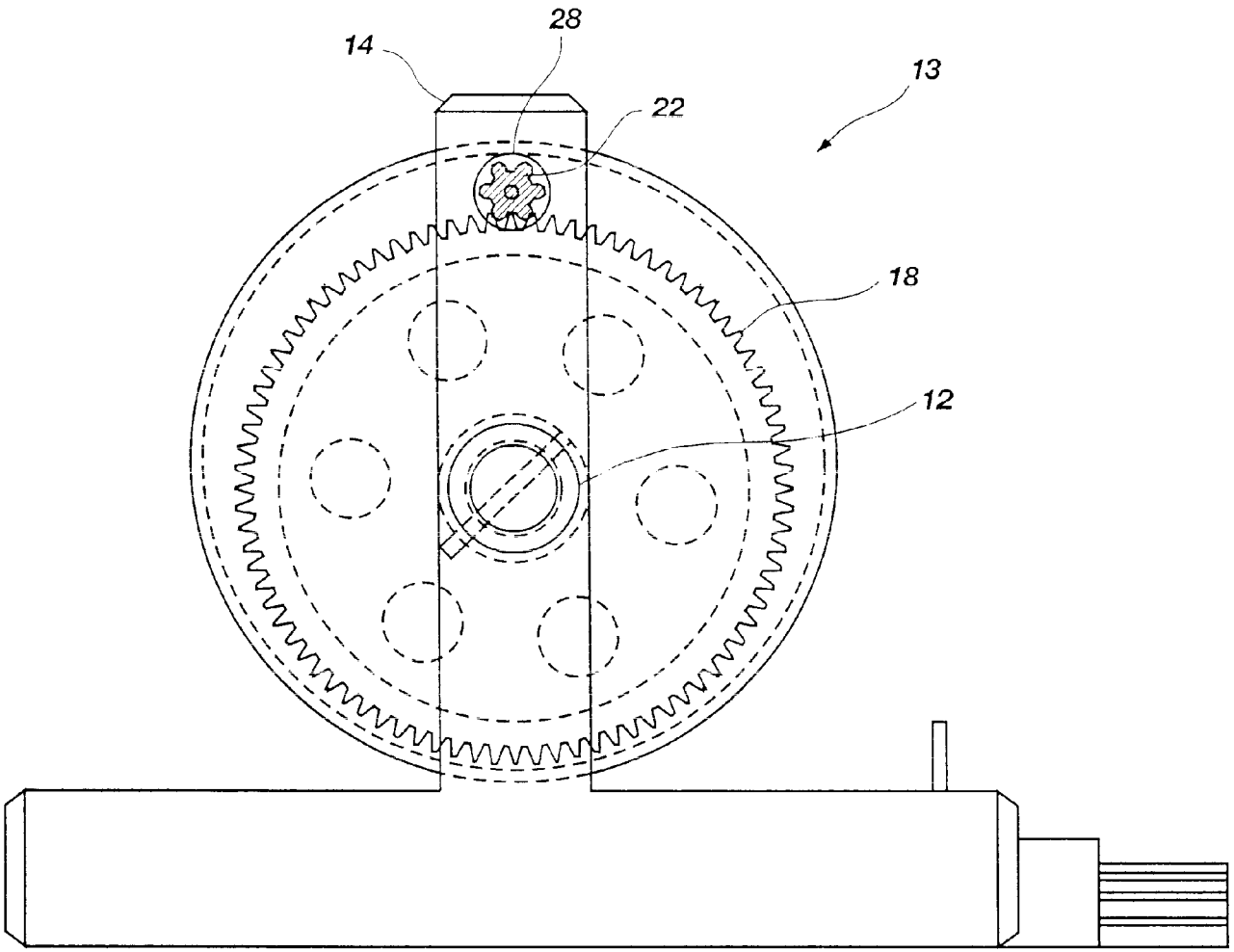
FIG. 2 is an end elevation view of the drive mechanism of FIG. 1.

FIG. 2 illustrates an end elevation view of the FIG. 1 embodiment of a drive mechanism 13 useful in either the cover collection apparatus 11 or the line collection apparatus 31. The view illustrates the pinion gear 22 having been inserted through aperture 28 in support structure 14, to engage the drive gear 18 in the manner previously described. FIG. 2 depicts one possible structure for the gear reduction means. By use of the gear reduction means, the low-torsion battery powered drill 24 is able to be used to wind either the pool cover 32 on the drum 15, or the line on the reels 33 and 35 without the need for high torsion power. While it is preferred to use a gear structure including one larger drive gear and a smaller power gear such as the drive gear 18, and the pinion gear 22 as the gear reduction means, it will be appreciated that the function of gear reduction can be performed by any structure that can be used as a gear reduction means known to those skilled in the art. All such gear reduction means are included within the scope of the present invention.

While any gear reduction ratio that enables a battery powered or other hand drill to operate the drum 15 or reels 33 and 35 may be used, the preferred ratio is a reduction of eleven (11) to one (1).

It is to be understood that the gear reduction means may instead be included as a structural feature or extension of the portable low voltage power source 24, such as a proprietary drill with a gear reduction end that attaches to a coupling means comprising a drive shaft 12 or a proprietary gear reduction means that attaches to a drill shaft 26 prior to attachment to the drive shaft 12. All such alternative embodiments readily ascertainable to those skilled in the art are within the scope of the present invention.

Figure 3:
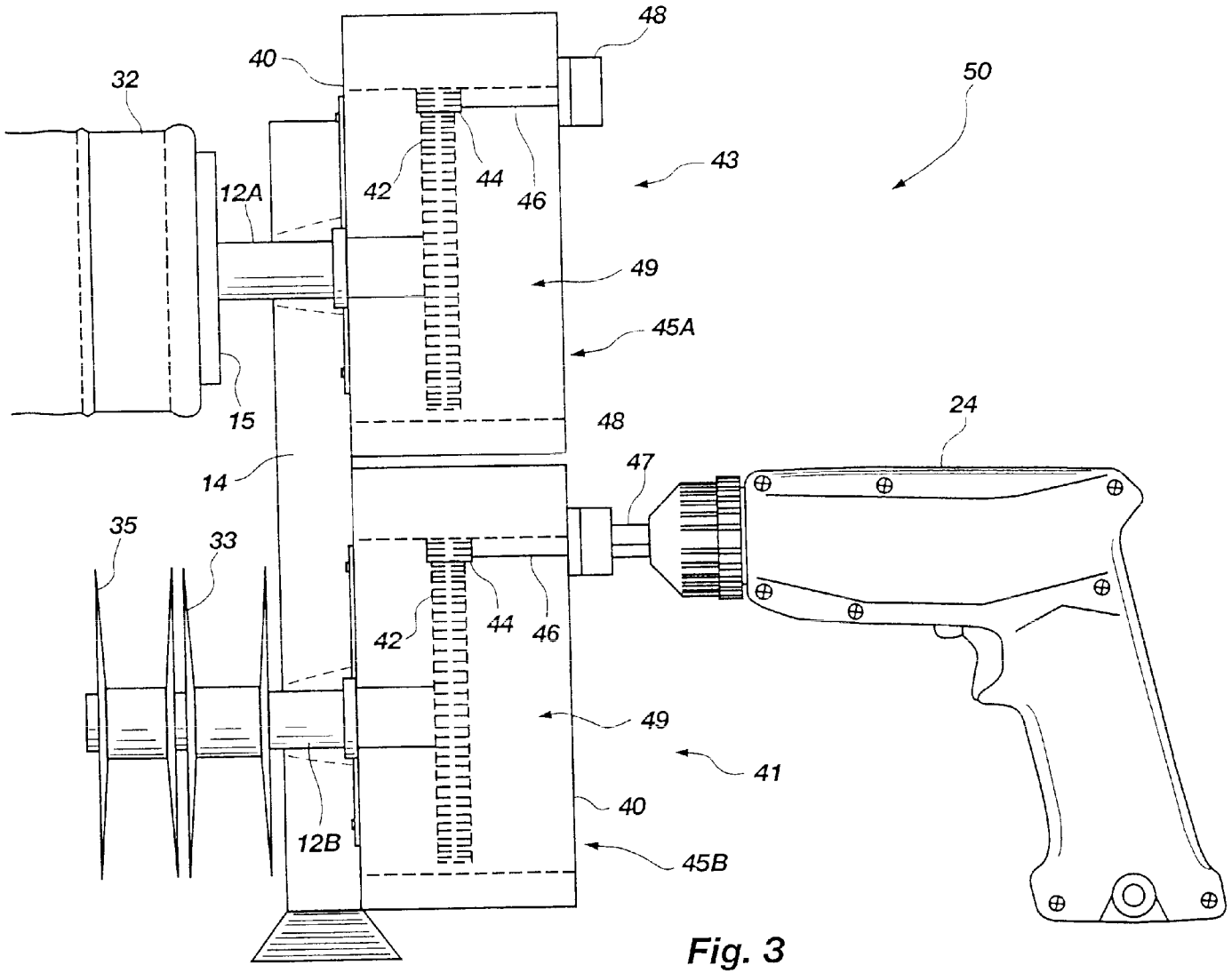
FIG. 3 is a side elevation view of a preferred embodiment of the pool cover system of FIG. 1.

FIG. 3 shows a preferred embodiment of a pool cover system including a drive mechanism, designated generally at 45, made in accordance with the principles of the present invention. Similar to FIGS. 1 and 2, the FIG. 3 embodiment features a gear reduction mechanism. Although any gear reduction mechanism may be used to practice the collection of the pool cover 32, or the line 79 (shown in FIG. 5) in cooperation with a portable drill 24 is within the scope of the present invention, it is preferred to use a gear reduction mechanism having two gears. In the FIG. 3 embodiment, there is a larger drive gear 42 and a smaller power gear 44. As in the embodiment shown in FIGS. 1 and 2, the preferred gear reduction ratio is eleven (11) to one (1). It will be appreciated that the gears 42 and 44 are supported by gear support structures that are not shown, and that any such structures allowing the gears to rotate may be used. This gear reduction system is contained within a housing 40.

In the FIG. 3 embodiment, the power gear 44 is not removable, unlike the pinion gear 22 of the FIGS. 1 and 2 embodiment. Instead, the power gear 44 continually remains in contact with the drive gear 42. The power gear 44 is connected to a power shaft 46 which is connected to a socket 48, located outside the housing 40. The socket 48 is adapted for connection to a bit 47 that may be removably inserted into the socket 48. The bit 47 attaches to the portable drill 24. It will be appreciated that connection of the drill 24 to the socket 48, thus serves as yet another example of a coupling means for removably coupling the low voltage power source or drill 24 to the drive mechanism 45.

It will be appreciated that power gear 44 remaining in contact with drive gear 42, as shown in the FIG.3, provides several advantages to the present invention. It eliminates the possibility of the power gear 42 being misplaced, or lost, by a user when the drive mechanism 45 is unused for a long period of time, as over the winter. Further, when the cover 32 is wound on the drum 15, or upon shaft 12 (if drum 15 is eliminated), the contact of the gears produces "drag" or resistance which operates as a restriction means to prevent the cover 32 from unrolling. Without a resistance means to prevent the cover 32 from unrolling off of a shaft, external forces such as wind will often cause such unrolling. Prior art attempts to provide resistance have been in the form of "pinch" brakes, that press upon a shaft, drum, or reel. Examples of pinch brakes may be seen in the Ragsdale reference in FIG. 5 thereof. The FIG. 3 embodiment adds drag to the drive mechanism 45 and thereby accomplishes the needed resistance without additional structure, such as pinch brakes.

Confining the power gear 44 to a permanent non-removable position within the housing 40 provides still further advantages. With the power gear 44 non-retractable and permanently fixed within the drive mechanism 45, the lubrication of the gear assembly is not compromised by continued removal and reinsertion of the power gear 44. Continued removal and reinsertion of the pinion gear 22 of FIG. 1 can sometimes cause grease to spill onto the pool deck 86, and can also cause the gear aperture 28 of FIG. 1 to become expanded over time. The expansion results in a looser engagement of the gear teeth of pinion gear 22 with the drive gear 18 of FIG. 1. Further, a removable pinion gear such as pinion gear 22 of FIG. 1 cannot be machined to a tight, wobble-free tolerance because it must be easily inserted and removed during each use. The non-retractable power gear 44 is machinable to a very tight, wobble-free tolerance to eliminate any initial or eventual looseness or play between the power gear 44 and the drive gear 42.

It is preferred that the housing 40 be a sealed housing to protect the gear reduction mechanism. It is further preferred that the sealed housing 40 be filled with a lubricant to further protect and lubricate the gear reduction mechanism. In the FIG. 3 embodiment, this is accomplished by filling the space 49, inside the housing with a lubricant. Any suitable lubricant may be used, but it is preferred to use a petroleum based oil.

It will be appreciated that the pool cover system embodiment show in FIG.3, also places the shafts 12A and 12B of the cover collection apparatus 43 and the line collection apparatus 41 in a co-linear parallel fashion, with one residing above the other. In this embodiment the cover collection apparatus 43 is disposed above the line collection apparatus 41, but it will be appreciated that all variations of this arrangement readily ascertainable to those skilled in the art that may be used to practice the present invention are included within the scope of the present invention.

FIG. 4 is a plan view of the pool cover system of FIG. 3. It will be appreciated that while drive mechanisms and an arrangement of the cover collection apparatus 41 and line collection apparatus 43 similar to that of FIG. 3 is pictured in FIG. 4 and are preferred, drive mechanisms and/or an arrangement similar to that shown in FIG. 1 may also be used.

The drive shaft 12A of the cover collection apparatus resides in a parallel fashion above the line collection apparatus drive shaft 12B (not visible). The shafts 12A and 12B preferably reside in vertical alighment. The pool cover 32 is collected on the drum 15 by winding and slidably extends and retracts over the pool 88 within the track 34.

The track 34 secures the cover 32 to the perimeter of the pool deck 86. In more preferred embodiments, there are two parallel tracks 34 located on opposite sides of the pool 88. This allows the cover 32 to be secured along multiple edges, by the tracks 34 and the shaft 12, or drum, and at the extended edge. The drive shaft 12A is turned to retract and wind the cover 32 onto the drum 15. The shaft 12B, residing below shaft 12A and therefore not visible in FIG. 4, is turned to pull lines 60 and 70 to thereby pull the cover 32 over the pool. Lines 60 and 70 are attached to opposite sides of the pool cover 32, respectively, such that both lines 60 and 70 pull the cover 32 simultaneously when shaft 12B is powered.

FIG. 5 depicts an exploded perspective view of the track 34 at the second end of the pool 88. It will be appreciated that the structures shown and described in FIG. 5 may be the same for either track 34 on either side of the pool 88. The pool cover 32 has a enlarged side edge 76 which slides in the first channel 78 of track 34, as the cover 32 is retracted or extended. The enlarged side edge 76 is attached to the line 79, preferably the line 79 runs through the enlarged side edge 78 to provide the enlargement of the enlarged side edge 79. At the end of the track 34, the line 79 wraps around a return pulley 80 and runs into a second channel 82 of the track 34. The return pulley 80 is preferably covered by a casing 84. As the line 79 is pulled at the first end of the pool 88, it moves into the second channel 82, shortening in the first channel 78, pulling the cover 32 to an extended position. When the cover 32 is retracted, the line 79 then travels into the first channel 78.

When the cover 32 is in an extended position covering the pool 88, the first channel 78 secures the large diameter side edge 76 of the cover 32 to the perimeter of the pool deck 86. The track 34 and other structures that may be used to secure the cover 32 along the sides of the pool 88 thus may function as perimeter securing means. In preferred embodiments, this is accomplished as explained above, but it will be appreciated that any perimeter securing means known to those skilled in the art may be used, and is within the scope of the present invention.

It is preferred that the pool cover and the tracks be compliant with ASTM Standard ES 13-89, published 1989 and entitled *Emergency Standard Performance Specification for Safety Covers and Labeling Requirements for All Covers for Swimming Pools, Spas and Hot Tubs*, which is incorporated herein by reference in its entirety. By complying with this standard, the pool cover 32 is able to support the weight of sufficient to prevent a person from falling into the pool 88 with the cover 32 in an extended position, and to effect the rescue of a person who is on the cover. The present invention thus has the ability to function as a safety cover, that is affordable and easy to use.

Returning to FIG. 4, a preferred arrangement for the lines 60 and 70 is shown. Distal line 60 is attached to the pool cover 32 on the side of the pool 88 furthest from the line collection apparatus, and resides in the channels 78 and 82 of the distal track 34B. Distal line 60 runs from the second channel 82 at the first end of the pool 88 to a first reel pulley 62 changing direction to a second reel pulley 64 and then onto line collection reel 33. It is preferred that line collection reel 33 be the reel nearest to the drive mechanisms 45. Proximal line 70 is attached to the pool cover 32 on the side of the pool 88 nearest to from the line collection apparatus, and resides in the channels 78 and 82 of the proximal track 34A. Proximal line 70 runs from the second channel 82 at the first end of the pool 88 to a third reel pulley 72 changing direction to a fourth reel pulley 74 and then onto line collection reel 35. It is preferred that line collection reel 33 be the reel furthest from the drive mechanisms 45.

It is preferred that proximal line 70 run to the line collection reel in a pathway closer to the pool cover system than distal line 60. It will be appreciated that other conformations that may be used to accomplish the connection may be used and are within the scope of the present invention. It will be further appreciated that the first, second, third and fourth reel pulleys may be covered to protect them. It will also be appreciated that it is within the scope of the present invention to place the cover collection apparatus and line collection apparatus within a recess, or other concealing means to present a more attractive appearance.

It will be appreciated that as shown in the embodiments of FIGS. 4 and 5, the operation of a pool cover system made in accordance with the principles of the present invention is simple and can be accomplished by a single user at one end of the pool 88, regardless of strength, through the use of a portable low voltage power source. The user merely attaches the low voltage power source to the line collection apparatus, and activates it to draw the lines 60 and 70 on to the reels 33 and 35. As the line in the tracks 34 is shortened, the pool cover 32 is drawn to an extended position over the pool 88. To uncover the pool 88, the user attaches the low voltage power source to the cover collection apparatus and activates it to wind the cover 32 on the drum 15, while drawing the lines 60 and 70 into the channels of the tracks 34. It will be appreciated that the rigid leading edge 68 attached to the pool cover 32 facilitates the extension and retraction of the cover 32.

Additionally, the embodiments shown illustrate how a pool cover system in accordance with the present invention may be configured so as to require only minor modification to the pool deck 86 for installation of the pool cover collecting means, rope reel collecting means, and tracks. It is not necessary to provide a pit to hide the device. It will be appreciated by those skilled in the art that such systems are simple in design and operation and may be installed by a non-expert user following instructions.

Figure 6:
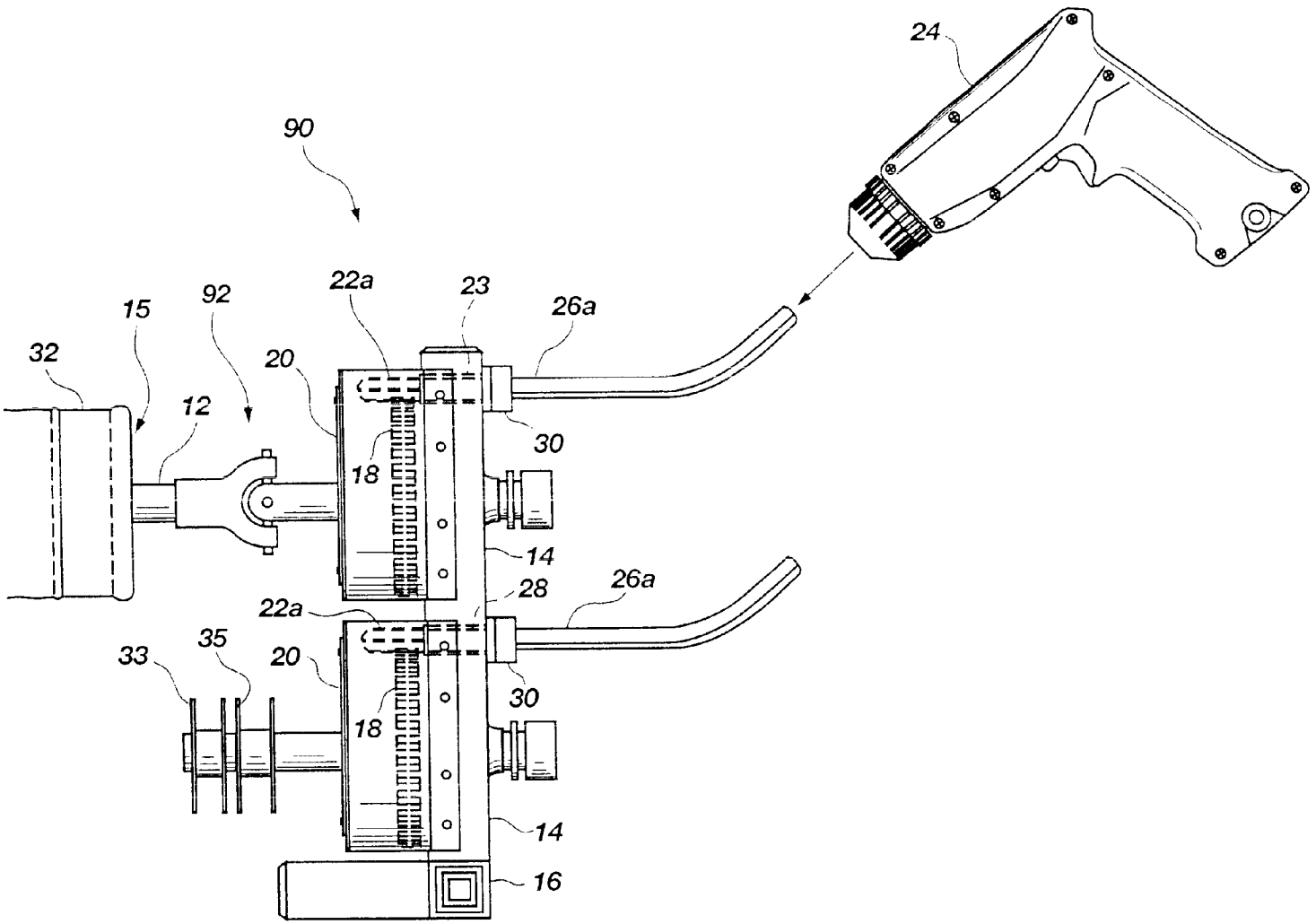
FIG. 6 is a side elevation view of another alternative embodiment of a pool cover collecting apparatus, made in accordance with the principles of the present invention.

Referring now to FIG. 6, there is shown another alternative embodiment of a drive mechanism, designated generally at 90, which is included within the present invention. Although the drive mechanism 90 is shown as part of a cover collection apparatus, it will be appreciated that the features of the FIG. 6 embodiment may be included in, or used with a line collection apparatus. The features and workings of the drive mechanism 90 includes many elements that are identical with the drive mechanism 13 of FIGS. 1–2, and those elements are referred to with identical reference numerals. The difference in drive mechanism 90 includes the addition of a universal joint 92 in the drive shaft 12, positioned between the drum 15 and the gear housing 20, and the addition of a flexible socket shaft 26*a*.

It will be appreciated that incorporation of the universal joint 92, in combination with the other elements of the drive mechanism 90, provides several distinct advantages. For example, the universal joint 92 permits the pool cover system to be mounted to an un-even deck 86 without imposing undesirable torsion on the drive shaft 12, and without the need to level the apparatus by placing shims or other leveling devices beneath the base 16 to ensure a "wobble-free" level installation. It is essential to the operation of automatic pool cover devices that torsional stress in the drive shaft 12 be avoided by undertaking laborious, time-consuming efforts to align the base 16 with the drum 15 on which the pool cover 32 is rolled. This usually presents a unique challenge with almost every pool 88, because most pool decks 86 are purposely sloped away from the pool 88 or are otherwise non-level in the area to which the pool cover apparatus is to be mounted. The incorporation of the universal joint 92 reduces or eliminates the need for precise alignment of the base 16 with the drum 15 and cover 32, which otherwise is required for the pool cover system.

The universal joint 92 also reduces or eliminates tension and binding in the gear assembly, which is usually present when any one or more of the following conditions arise: (1) if the system is mounted to an un-even pool deck 86; (2) if the drive shaft 12 is attached to the drive mechanism 90 imprecisely, creating an eccentricity causing the drum 15, or reels, to wobble; (3) if the drum 15 begins to sag in the middle, which is inevitable over time, especially in the case of wide-pool versions of the system.

Another improvement is the use of a flexible socket adapter 26*a*. It will be appreciated that it can be difficult to place the drill 24 close enough and in proper alignment for convenient operation, particularly when the pool cover system is recessed below the pool deck 86. In such cases, use of the flexible socket adapter 26*a* permits the drill 24 to rotate the adapter 26*a* even without being perfectly aligned with the adapter 26*a*. The use of the flexible adapter 26*a* also makes operation more convenient for elderly or physically challenged users to operate the drive mechanism 90 without having to kneel in order to attach the drill 24.

Rendering pinion gear 22*a* non-removable provides still further advantages. With the pinion gear 22*a* non-retractable and permanently fixed to the gear assembly, the lubrication of the gear assembly is not compromised by continued removal and reinsertion of the pinion gear. Continued removal and reinsertion of the pinion gear can sometimes causes grease to spill onto the pool deck 86, and also causes the pinion-gear slot to become expanded over time. The expansion results in a looser engagement of the pinion gear teeth with the drive gear 18. Further, a removable pinion gear such as gear 22 of FIG. 1 cannot be machined to a tight, wobble-free tolerance because it must be easily inserted and removed during each use. The non-retractable pinion gear 22*a* is machinable to a very tight, wobble-free tolerance to eliminate any initial or eventual looseness or play between the pinion gear 22*a* and the drive gear 18.

The present invention further includes a method of uncovering a pool using a pool cover system allowing the pool to be opened and closed from one end of the pool. This method comprises the steps of:

(a) installing a pool cover system, comprising
  a portable low voltage power source;
  a pool cover;
  retracting means for retracting the pool cover from an extended position covering the pool, the retracting means being fixedly attached to a pool deck;
  first coupling means for temporarily and releasably coupling the portable low voltage power source to the retracting means, such that the low voltage power source may be activated to cause the retracting means to retract the pool cover from an extended position, the first coupling means accessible at a first end of the pool;
  extending means for extending the pool cover to an extended position covering the pool;
  second coupling means for temporarily and releasably coupling the portable low voltage power source to the extending means, such that the low voltage power source may be activated to cause the extending means to extend the pool cover to an extended position, the second coupling means accessible at the first end of the pool;

(b) connecting the low voltage power source to the first coupling means;

(c) activating the low voltage power source to cause the pool cover to be retracted from the extended position.

In a preferred embodiment of this method the first coupling means includes first gear reduction means, the first gear reduction means adapted for temporarily and releasably coupling with the portable low voltage power source, such that the low voltage power source may be activated to cause the retracting means to retract the pool cover from an extended position, the first gear reduction means including a gear reduction mechanism.

In a more preferred embodiment of the preferred method the first gear reduction means comprises:

a first housing, at least one retraction shaft attached to the retracting means, a first power shaft adapted to temporarily and releasably attaching to the portable low voltage power source, and a first gear reduction mechanism disposed inside the first housing, the first gear reduction mechanism operably connected to the at least one retraction shaft and the first power shaft, such that the low voltage power source may be activated to cause the retracting means to retract the pool cover from an extended position by activating the retracting means through the rotating the at least one retraction shaft through action of the first gear reduction mechanism;

restriction means for restricting the pool cover from extending from the retracted position when the pool cover is in the retracted position.

The method can further comprise a method of covering the pool by further comprising the steps of:

(d) connecting the low voltage power source to the second coupling means;

(e) activating the low voltage power source to cause the pool cover to be extended to the extended position.

In a preferred embodiment, the second coupling means includes second gear reduction means, the second gear reduction means adapted for temporarily and releasably coupling with the portable low voltage power source, such that the low voltage power source may be activated to cause the extending means to extend the pool cover to an extended position, the second gear reduction means including a gear reduction mechanism.

In a more preferred embodiment of the preferred method including extending the pool cover, the second gear reduction means comprises a second housing, at least one extension shaft attached to the extending means, a second power shaft adapted to temporarily and releasably attaching to the portable low voltage power source, and a second gear reduction mechanism disposed inside the second housing, the second gear reduction mechanism operably connected to the at least one extension shaft and the second power shaft, such that the low voltage power source may be activated to cause the extending means to extend the pool cover to an extended position by activating the extending means through the rotating the at least one extension shaft through action of the second gear reduction mechanism.

It is preferred that this method be practiced with a pool cover 32 that is a flexible pool cover, although it will be appreciated that other types of pool covers, such as a rigid pool cover, or a pool cover made of rigid panels that fold or slide over one another, or are made of a combination of rigid and flexible segments may be used within the scope of the present invention. It is more preferred for the retracting means to comprise a cover collection shaft on which the pool cover is wound when the pool cover is retracted. It is most preferred for a the cover collection shaft to include a drum on which the cover is rolled.

The present invention also includes a method uncovering a pool of using a pool cover system adapted for using a portable low voltage power source operable to extend and retract one end of a pool. This method comprises the steps of:

(a) installing a pool cover system, comprising a pool cover;

retracting means for retracting the pool cover from an extended position covering the pool, the retracting means being fixedly attached to a pool deck, the retracting means configured and adapted to be activated by use of a portable low voltage power source, the retracting means located at a first end of the pool;

first coupling means for temporarily and releasably coupling the portable low voltage power source to the retracting means, such that the low voltage power source may be activated to cause the retracting means to retract the pool cover from an extended position;

extending means for extending the pool cover to an extended position covering the pool, the extending means configured and adapted to be activated by use of a portable low voltage power source, the extending means located at the first end of the pool;

second coupling means for temporarily and releasably coupling the portable low voltage power source to the retracting means, such that the low voltage power source may be activated to cause the retracting means to retract the pool cover from an extended position;

(b) connecting the low voltage power source to the first coupling means;

(c) activating the low voltage power source to cause the pool cover to be retracted from the extended position.

This method may further include a method of covering the pool comprising the steps of:

(d) connecting the low voltage power source to the second coupling means;

(e) activating the low voltage power source to cause the pool cover to be extended to the extended position.

The present invention also includes a method of method of using a pool cover system including perimeter securing means, and operable using portable low voltage power source at one end of the pool to extend and retract the cover. This method comprises the steps of:

(a) installing a pool cover system, comprising a pool cover;

a portable low voltage power source;

retracting means for retracting the pool cover from an extended position covering the pool, the retracting means located at a first end of the pool;

first coupling means for temporarily and releasably coupling the portable low voltage power source to the retracting means, such that the low voltage power source may be activated to cause the retracting means to retract the pool cover from an extended position;

extending means for extending the pool cover to an extended position covering the pool, the extending means located at the first end of the pool;

second coupling means for temporarily and releasably coupling the portable low voltage power source to the extending means, such that the low voltage power source may be activated to cause the extending means to extend the pool cover to an extended position;

perimeter securing means for securing the pool cover to the perimeter of the pool along at least two edges of the pool when the pool cover is in an extended position covering the pool;

(b) connecting the low voltage power source to the first coupling means;

(c) activating the low voltage power source to cause the pool cover to be retracted from the extended position.

It is preferred to further cover include the steps of (d) connecting the low voltage power source to the second coupling means; and (e) activating the low voltage power source to cause the pool cover to be extended to the extended position, within this method.

It will be appreciated that the present invention thus provides a pool cover system that is relatively easy to operate, may provide a safety cover that may be operated by a single user, and does not require major modification of the pool deck for installation. This system is operable with only a low-torsion, low-voltage power source for operation.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A system for uncovering and covering a swimming pool, comprising:

a portable low voltage power source;

a pool cover;

retracting means for retracting the pool cover from an extended position covering the pool, the retracting means being fixedly attached to a pool deck;

first coupling means for temporarily and releasably coupling the portable low voltage power source to the retracting means, such that the low voltage power source may be activated to cause the retracting means to retract the pool cover from an extended position, the first coupling means accessible at a first end of the pool, wherein the extending means is resting adjacent the retracting means;

extending means for extending the pool cover to an extended position covering the pool;

second coupling means for temporarily and releasably coupling the portable low voltage power source to the extending means, such that the low voltage power source may be activated to cause the extending means to extend the pool cover to an extended position, the second coupling means accessible at the first end of the pool.

2. The system of claim 1, where the portable low voltage power source is a rechargeable electric drill.

3. The system of claim 2, further comprising a gear reduction mechanism attached to the rechargeable electric drill, said gear reduction mechanism releasably attachable to the first coupling means or the second coupling means, such that the rechargeable electric drill may be activated to cause the cover to be extended or retracted.

4. The system of claim 1, where the first coupling means includes first gear reduction means, the first gear reduction means adapted for temporarily and releasably coupling with the portable low voltage power source, such that the low voltage power source may be activated to cause the retracting means to retract the pool cover from an extended position, the first gear reduction means including a gear reduction mechanism.

5. The system of claim 4, wherein the gear reduction means includes a relatively smaller diameter gear that is operably connected to the portable low voltage power source, when the portable low voltage power source is coupled to the gear reduction means and a relatively larger diameter gear that us operably connected to the retracting means.

6. The system of claim 5, wherein the relatively smaller diameter gear is removable from the gear reduction means.

7. The system of claim 4, where the first gear reduction means comprises:

a first housing, at least one retraction shaft attached to the retracting means, a first power shaft adapted to temporarily and releasably attaching to the portable low voltage power source, and a first gear reduction mechanism disposed inside the first housing, the first gear reduction mechanism operably connected to the at least one retraction shaft and the first power shaft, such that the low voltage power source may be activated to cause the retracting means to retract the pool cover from an extended position by activating the retracting means through the rotating the at least one retraction shaft through action of the first gear reduction mechanism;

resistance means for restricting the pool cover from extending from the retracted position when the pool cover is in the retracted position.

8. The system of claim 7, wherein the gear reduction mechanism comprises the resistance means.

9. The system of claim 8, wherein the gear reduction mechanism includes a relatively smaller diameter gear that is operably connected to the power shaft, and a relatively larger diameter gear that is operably connected to the at least one retraction shaft.

10. The system of claim 9, wherein the first housing is a sealed housing.

11. The system of claim 10, wherein the sealed housing is filled with a lubricant.

12. The system of claim 11, wherein the lubricant is a petroleum based oil.

13. The system of claim 4, where the second coupling means includes second gear reduction means, the second gear reduction means adapted for temporarily and releasably coupling with the portable low voltage power source, such that the low voltage power source may be activated to cause the extending means to extend the pool cover to an extended position, the second gear reduction means including a gear reduction mechanism.

14. The system of claim 4, wherein the gear reduction means includes a relatively smaller diameter gear that is operably connected to the portable low voltage power source, when the portable low voltage power source is coupled to the gear reduction means and a relatively larger diameter gear that us operably connected to the retracting means.

15. The system of claim 14, wherein the relatively smaller diameter gear is removable from the gear reduction means.

16. The system of claim 13 where the second gear reduction means comprises a second housing, at least one extension shaft attached to the extending means, a second power shaft adapted to temporarily and releasably attaching to the portable low voltage power source, and a second gear reduction mechanism disposed inside the second housing, the second gear reduction mechanism operably connected to the at least one extension shaft and the second power shaft, such that the low voltage power source may be activated to cause the extending means to extend the pool cover to an extended position by activating the extending means through the rotating the at least one extension shaft through action of the second gear reduction mechanism.

17. The system of claim 16, wherein the second gear reduction mechanism includes a relatively smaller diameter gear that is operably connected to the second power shaft, and a relatively larger diameter gear that is operably connected to the at least one extension shaft.

18. The system of claim 17, wherein the second housing is a sealed housing.

19. The system of claim 18, wherein the sealed housing is filled with a lubricant.

20. The system of claim 19, wherein the lubricant is a petroleum based oil.

21. The system of claim 1, where the pool cover is a flexible pool cover.

22. The system of claim 21, where the retracting means comprises a cover collection shaft on which the pool cover is wound when the pool cover is retracted.

23. The system of claim 21, where the extending means further comprises a line collection shaft on which at least a first line attached to the pool cover is wound as the pool cover is extended.

24. The system of claim 23, where the extending means further comprises at least a first reel located on the line collection shaft on which the at least first line is wound.

25. The system of claim 24, further comprising at least a first pulley located at a second end of the pool, opposite the first end, through which the at least first line runs to the line collection shaft from the pool cover.

26. The system of claim 24, where the cover collection shaft and the line collection shaft are co-linearly aligned along respective long axes.

27. The system of claim 26, where the cover collection shaft and the line collection shaft are co-linearly aligned along respective long axes in a vertical manner.

28. The system of claim 24, where the cover collection shaft and the line collection shaft are not aligned co-linearly aligned.

29. The system of claim 23, where the at least first line is attached to a side edge of the pool cover.

30. The system of claim 29, further comprising a second line attached to an opposite side edge of the pool cover.

31. The system of claim 30, where the extending means further comprises a second reel located on the line collection shaft on which the second line is wound.

32. The system of claim 31, further comprising a second pulley located at a second end of the pool, opposite the first end, through which the second line runs to the second reel from the pool cover.

33. The system of claim 23, where the first coupling means includes first gear reduction means, the first gear reduction means adapted for temporarily and releasably coupling with the portable low voltage power source, such that the low voltage power source may be activated to cause the retracting means to retract the pool cover from an extended position, the first gear reduction means including a gear reduction mechanism.

34. The system of claim 33, where the first gear reduction means comprises:

a first housing, at least one retraction shaft attached to the retracting means, a first power shaft adapted to temporarily and releasably attaching to the portable low voltage power source, and a first gear reduction mechanism disposed inside the first housing, the first gear reduction mechanism operably connected to the at least one retraction shaft and the first power shaft, such that the low voltage power source may be activated to cause the retracting means to retract the pool cover from an extended position by activating the retracting means through the rotating the at least one retraction shaft through action of the first gear reduction mechanism;

resistance means for restricting the pool cover from extending from the retracted position when the pool cover is in the retracted position.

35. The system of claim 33, where the second coupling means includes second gear reduction means, the second gear reduction means adapted for temporarily and releasably coupling with the portable low voltage power source, such that the low voltage power source may be activated to cause the extending means to extend the pool cover to an extended position, the second gear reduction means including a gear reduction mechanism.

36. The system of claim 35 where the second gear reduction means comprises a second housing, at least one extension shaft attached to the extending means, a second power shaft adapted to temporarily and releasably attaching to the portable low voltage power source, and a second gear reduction mechanism disposed inside the second housing, the second gear reduction mechanism operably connected to the at least one extension shaft and the second power shaft, such that the low voltage power source may be activated to cause the extending means to extend the pool cover to an extended position by activating the extending means through the rotating the at least one extension shaft through action of the second gear reduction mechanism.

37. The system of claim 1, where the extending means further comprises at least a first reel on which at least a first line is wound as the pool cover is extended.

38. The system of claim 37, where the at least first line is attached to the pool cover.

39. A system for uncovering and covering a swimming pool, comprising:

a pool cover;

retracting means for retracting the pool cover from an extended position covering the pool, the retracting means being fixedly attached to a pool deck, the retracting means configured and adapted to be activated by use of a portable low voltage power source, the retracting means located at a first end of the pool;

first coupling means for temporarily and releasably coupling the portable low voltage power source to the retracting means, such that the low voltage power source may be activated to cause the retracting means to retract the pool cover from an extended position;

extending means for extending the pool cover to an extended position covering the pool, the extending means configured and adapted to be activated by use of a portable low voltage power source, the extending means located at the first end of the pool, wherein the extending means is resting adjacent the retracting means;

second coupling means for temporarily and releasably coupling the portable low voltage power source to the retracting means, such that the low voltage power source may be activated to cause the retracting means to retract the pool cover from an extended position.

40. The system of claim 39, where the portable low voltage power source is a rechargeable electric drill.

41. A system for uncovering a swimming pool, comprising:

a pool cover;

a portable low voltage power source;

retracting means for retracting the pool cover from an extended position covering the pool, the retracting means located at a first end of the pool;

first coupling means for temporarily and releasably coupling the portable low voltage power source to the retracting means, such that the low voltage power source may be activated to cause the retracting means to retract the pool cover from an extended position;

extending means for extending the pool cover to an extended position covering the pool, the extending means located at the first end of the pool, wherein the extending means is resting adjacent the retracting means;

second coupling means for temporarily and releasably coupling the portable low voltage power source to the extending means, such that the low voltage power source may be activated to cause the extending means to extend the pool cover to an extended position;

perimeter securing means for securing the pool cover to the perimeter of the pool along at least two edges of the pool when the pool cover is in an extended position covering the pool.

42. The system of claim 41, where the portable low voltage power source is a rechargeable electric drill.

43. The system of claim 41, wherein the perimeter securing means further comprises at least a first track, in which the pool cover slidably extends and retracts.

44. The system of claim 43, wherein the at least a first track is a dual channel track with a first channel and a second channel.

45. The system of claim 44, wherein the extending means includes at least a first line attached to the pool cover.

46. The system of claim 45, where the at least first line is slidably disposed in the channels of the at least a first track.

47. The system of claim 46, further comprising a pulley located at a second end of the at least a first track, the at least a first line wrapping around said pulley into the channels of the track.

48. The system claim 47, where the extending means further comprises a line collection shaft located at the first end of the pool to which the at least first line runs from the second channel of the at least first track, such that the at least first line is wound on the line collection shaft when the cover is in an extended position.

49. The system of claim 48, further comprising at least a first collection reel disposed on the line collection shaft, such that the at least first line is wound on at least a first reel when the cover is in an extended position.

50. The system of claim 49, where the pool cover is a flexible pool cover.

51. The system of claim 50, where the retracting means further comprises a cover collection shaft on which the flexible pool cover is wound when the pool cover is in a retracted position.

52. The system of claim 51, where the at least a first line is attached to a first side edge of the flexible pool cover.

53. The system of claim 51, where the flexible pool cover is disposed so the first side edge resides in the first channel of the at least first track, such that the cover slidably extends in the first channel of the at least first track as the at least first line is wound on the at least a first reel and slidably retracts in the first channel of the at least first track as the flexible cover is wound on the cover collection shaft.

54. The system of claim 53, wherein the perimeter securing means further comprises a second track in which the pool cover slidably extends and retracts.

55. The system of claim 54, wherein the first and second tracks are parallel to one another and are disposed on opposite parallel sides of the pool.

56. The system of claim 55, wherein the second track is a dual channel track with a first channel and a second channel.

57. The system of claim 56, wherein the extending means includes a second line attached to the pool cover.

58. The system of claim 57, where the second line is slidably disposed in the channels of the second first track.

59. The system of claim 58, further comprising a second pulley located at a second end of the second track, the second line wrapping around said second pulley into the channels of the second track.

60. The system of claim 59, further comprising a second collection reel disposed on the line collection shaft, such that the second line is wound on the second when the cover is in an extended position.

61. The system of claim 60, where the second line is attached to a second side edge of the flexible pool cover.

62. The system of claim 61, where the flexible pool cover is disposed so the second side edge resides in the first channel of the second track, such that the cover slidably extends in the first channel of the second track as the second line is wound on the second reel and slidably retracts in the first channel of the second track as the flexible cover is wound on the cover collection shaft.

63. The system of claim 62, further comprising a first reel pulley located at the first end of the pool through which the at least a first line runs from the at least first track to the at least first reel.

64. The system of claim 63, further comprising a second reel pulley through which the at least first line runs from the first reel pulley to the at least first reel, said first reel pulley and second reel pulley guiding the at least first line in extending and retracting the pool cover.

65. The system of claim 64, further comprising a second reel pulley located at the first end of the pool through which the second line runs from the second track to the second reel.

66. The system of claim 65 further comprising a fourth reel pulley through which the second line runs from the third reel pulley to the second one reel, said third reel pulley and fourth reel pulley guiding the second line in extending and retracting the pool cover.

67. The system of claim 66, where the second line runs through the third and fourth reel pulleys in a position that lies outside the position at least first line runs through the first and second reel pulleys, with respect to the pool.

68. The system of claim 51, where the cover collection shaft and the line collection shaft are co-linearly aligned along respective long axes.

69. The system of claim 68, where the cover collection shaft and the line collection shaft are co-linearly aligned along respective long axes in a vertical manner.

70. The system of claim 69, where the cover collection shaft and the line collection shaft are not aligned co-linearly aligned.

71. The system of claim 41, wherein the pool cover system complies with ASTM standards for a pool safety cover.

72. The system of claim 41, where the first coupling means includes first gear reduction means, the first gear reduction means adapted for temporarily and releasably coupling with the portable low voltage power source, such that the low voltage power source may be activated to cause the retracting means to retract the pool cover from an extended position, the first gear reduction means including a gear reduction mechanism.

73. The system of claim 72, wherein the gear reduction means includes a relatively smaller diameter gear that is operably connected to the portable low voltage power source, when the portable low voltage power source is coupled to the gear reduction means and a relatively larger diameter gear that us operably connected to the retracting means.

74. The system of claim 73, wherein the relatively smaller diameter gear is removable from the gear reduction means.

75. The system of claim 74, wherein the gear reduction mechanism comprises the resistance means.

76. The system of claim 72, where the first gear reduction means comprises:

a first housing, at least one retraction shaft attached to the retracting means, a first power shaft adapted to temporarily and releasably attaching to the portable low voltage power source, and a first gear reduction mechanism disposed inside the first housing, the first gear reduction mechanism operably connected to the at least one retraction shaft and the first power shaft, such that the low voltage power source may be activated to cause the retracting means to retract the pool cover from an extended position by activating the retracting means through the rotating the at least one retraction shaft through action of the first gear reduction mechanism;

resistance means for restricting the pool cover from extending from the retracted position when the pool cover is in the retracted position.

77. The system of claim 76, wherein the gear reduction mechanism includes a relatively smaller diameter gear that is operably connected to the power shaft, and a relatively larger diameter gear that is operably connected to the at least one retraction shaft.

78. The system of claim 77, wherein the first housing is a sealed housing.

79. The system of claim 78, wherein the sealed housing is filled with a lubricant.

80. The system of claim 79, wherein the lubricant is a petroleum based oil.

81. The system of claim 72, where the second coupling means includes second gear reduction means, the second gear reduction means adapted for temporarily and releasably coupling with the portable low voltage power source, such that the low voltage power source may be activated to cause the extending means to extend the pool cover to an extended position, the second gear reduction means including a gear reduction mechanism.

82. The system of claim 81, wherein the gear reduction means includes a relatively smaller diameter gear that is operably connected to the portable low voltage power source, when the portable low voltage power source is coupled to the gear reduction means and a relatively larger diameter gear that us operably connected to the retracting means.

83. The system of claim 82, wherein the relatively smaller diameter gear is removable from the gear reduction means.

84. The system of claim 81 where the second gear reduction means comprises a second housing, at least one extension shaft attached to the extending means, a second power shaft adapted to temporarily and releasably attaching to the portable low voltage power source, and a second gear reduction mechanism disposed inside the second housing, the second gear reduction mechanism operably connected to the at least one extension shaft and the second power shaft, such that the low voltage power source may be activated to cause the extending means to extend the pool cover to an extended position by activating the extending means through the rotating the at least one extension shaft through action of the second gear reduction mechanism.

85. The system of claim 84, wherein the second gear reduction mechanism includes a relatively smaller diameter gear that is operably connected to the second power shaft, and a relatively larger diameter gear that is operably connected to the at least one extension shaft.

86. The system of claim 85, wherein the second housing is a sealed housing.

87. The system of claim 86, wherein the sealed housing is filled with a lubricant.

88. The system of claim 87, wherein the lubricant is a petroleum based oil.

89. A method of uncovering and covering a pool comprising the steps of:

(a) installing a pool cover system, comprising a portable low voltage power source;

a pool cover;

retracting means for retracting the pool cover from an extended position covering the pool, the retracting means being fixedly attached to a pool deck;

first coupling means for temporarily and releasably coupling the portable low voltage power source to the retracting means, such that the low voltage power source may be activated to cause the retracting means to retract the pool cover from an extended position, the first coupling means accessible at a first end of the pool;

extending means for extending the pool cover to an extended position covering the pool, wherein the extending means is resting adjacent the retracting means;

second coupling means for temporarily and releasably coupling the portable low voltage power source to the extending means, such that the low voltage power source may be activated to cause the extending means to extend the pool cover to an extended position, the second coupling means accessible at the first end of the pool;

(b) connecting the low voltage power source to the first coupling means;

(c) activating the low voltage power source to cause the pool cover to be retracted from the extended position.

90. The method of claim 89 further comprising the steps of:

(d) connecting the low voltage power source to the second coupling means;

(e) activating the low voltage power source to cause the pool cover to be extended to the extended position.

91. The method of claim 89, where the first coupling means includes first gear reduction means, the first gear reduction means adapted for temporarily and releasably coupling with the portable low voltage power source, such that the low voltage power source may be activated to cause the retracting means to retract the pool cover from an extended position, the first gear reduction means including a gear reduction mechanism.

92. The method of claim 91, where the first gear reduction means comprises:

a first housing, at least one retraction shaft attached to the retracting means, a first power shaft adapted to temporarily and releasably attaching to the portable low voltage power source, and a first gear reduction mechanism disposed inside the first housing, the first gear reduction mechanism operably connected to the at least one retraction shaft and the first power shaft, such that the low voltage power source may be activated to cause the retracting means to retract the pool cover from an extended position by activating the retracting means through the rotating the at least one retraction shaft through action of the first gear reduction mechanism;

resistance means for restricting the pool cover from extending from the retracted position when the pool cover is in the retracted position.

93. The method of claim 90, where the second coupling means includes second gear reduction means, the second gear reduction means adapted for temporarily and releasably coupling with the portable low voltage power source, such that the low voltage power source may be activated to cause the extending means to extend the pool cover to an extended position, the second gear reduction means including a gear reduction mechanism.

94. The method of claim 93, where the second gear reduction means comprises a second housing, at least one extension shaft attached to the extending means, a second power shaft adapted to temporarily and releasably attaching to the portable low voltage power source, and a second gear reduction mechanism disposed inside the second housing, the second gear reduction mechanism operably connected to the at least one extension shaft and the second power shaft, such that the low voltage power source may be activated to cause the extending means to extend the pool cover to an extended position by activating the extending means through the rotating the at least one extension shaft through action of the second gear reduction mechanism.

95. The method of claim 89, where the pool cover is a flexible pool cover.

96. The method of claim 95, where the retracting means comprises a cover collection shaft on which the pool cover is wound when the pool cover is retracted.

97. The method of claim 96, where the extending means further comprises a line collection shaft on which at least a first line attached to the pool cover is wound as the pool cover is extended.

98. The method of claim 97, where the cover collection shaft and the line collection shaft are co-linearly aligned along respective long axes in a vertical manner.

99. The method of claim 89, where the extending means further comprises at least a first reel on which at least a first line is wound as the pool cover is extended.

100. The method of claim 99, where the at least first line is attached to the pool cover.

101. A method of uncovering and covering a pool comprising the steps of:

(a) installing a pool cover system, comprising a pool cover;

retracting means for retracting the pool cover from an extended position covering the pool, the retracting means being fixedly attached to a pool deck, the retracting means configured and adapted to be activated by use of a portable low voltage power source, the retracting means located at a first end of the pool;

first coupling means for temporarily and releasably coupling the portable low voltage power source to the retracting means, such that the low voltage power source may be activated to cause the retracting means to retract the pool cover from an extended position;

extending means for extending the pool cover to an extended position covering the pool, the extending means configured and adapted to be activated by use of a portable low voltage power source, the extending means located at the first end of the pool, and wherein the extending means is resting adjacent the retracting means;

second coupling means for temporarily and releasably coupling the portable low voltage power source to the retracting means, such that the low voltage power source may be activated to cause the retracting means to retract the pool cover from an extended position;

(b) connecting the low voltage power source to the first coupling means;

(c) activating the low voltage power source to cause the pool cover to be retracted from the extended position.

102. The method of claim 101 further comprising the steps of:

(d) connecting the low voltage power source to the second coupling means;

(e) activating the low voltage power source to cause the pool cover to be extended to the extended position.

103. A method of uncovering and covering a pool comprising the steps of:

(a) installing a pool cover system, comprising a pool cover;

a portable low voltage power source;

retracting means for retracting the pool cover from an extended position covering the pool, the retracting means located at a first end of the pool, and wherein the extending means is resting adjacent the retracting means;

first coupling means for temporarily and releasably coupling the portable low voltage power source to the retracting means, such that the low voltage power source may be activated to cause the retracting means to retract the pool cover from an extended position;

extending means for extending the pool cover to an extended position covering the pool, the extending means located at the first end of the pool;

second coupling means for temporarily and releasably coupling the portable low voltage power source to the extending means, such that the low voltage power source may be activated to cause the extending means to extend the pool cover to an extended position;

perimeter securing means for securing the pool cover to the perimeter of the pool along at least two edges of the pool when the pool cover is in an extended position covering the pool;

(b) connecting the low voltage power source to the first coupling means;

(c) activating the low voltage power source to cause the pool cover to be retracted from the extended position.

104. The method of claim 103 further comprising the steps of:

(d) connecting the low voltage power source to the second coupling means;

(e) activating the low voltage power source to cause the pool cover to be extended to the extended position.

* * * * *